US005391067A

United States Patent [19]

Saunders

[11] Patent Number: 5,391,067

[45] Date of Patent: Feb. 21, 1995

[54] ROTARY FLUID DISPLACEMENT DEVICE

[76] Inventor: James E. Saunders, 2069 Madison Ave., Ogden, Utah 84401

[21] Appl. No.: 93,891

[22] Filed: Jul. 20, 1993

[51] Int. Cl.[6] ..... F01C 1/22; F01C 19/04

[52] U.S. Cl. ..... 418/60; 418/61.2; 418/125; 418/150

[58] Field of Search ..... 418/60, 61.2, 125, 150

[56] References Cited

U.S. PATENT DOCUMENTS

| | | | |
|---|---|---|---|
| 3,134,337 | 5/1964 | Paschke | 418/61.2 |
| 3,744,940 | 7/1973 | Pierce et al. | 418/61.2 |
| 4,012,180 | 3/1977 | Berkowitz et al. | 418/141 |
| 4,018,548 | 4/1977 | Berkowitz | 418/61.2 |
| 4,043,714 | 8/1977 | Berkowitz | 418/123 |
| 4,156,586 | 5/1979 | Morris | 418/113 |

FOREIGN PATENT DOCUMENTS

| | | | |
|---|---|---|---|
| 1934262 | 8/1970 | Germany | 418/61.2 |
| 2021513 | 11/1971 | Germany | 418/61.2 |
| 2239992 | 2/1974 | Germany | 418/125 |
| 2341963 | 3/1975 | Germany | 418/61.2 |
| 3335721 | 4/1985 | Germany | 418/60 |
| 583035 | 12/1946 | United Kingdom | 418/61.2 |

*Primary Examiner*—John J. Vrablik
*Attorney, Agent, or Firm*—A. Ray Osburn

[57] ABSTRACT

A rotary fluid displacement device having no indexing gearing between the rotor and the crankshaft therefor. Housing and rotor shapes are determined by equations, so that the rotor is guided at three apexes by the housing contour so that no gearing is required. The devices may be employed in pairs to produce a constant rate of fluid displacement.

4 Claims, 5 Drawing Sheets

ROTARY FLUID DISPLACEMENT DEVICE

BACKGROUND OF THE INVENTION

1. Field

The invention relates to devices having rotors operating inside housings to provide expanding and contracting chambers.

2. State of the Art

Various rotary compressors, pumps expansion devices have been proposed in the art, wherein the rotor is an irregular cylinder angularly symmetrical about its axis of rotation. The rotors are mounted within the housing to rotate eccentrically with respect to the shaft of the device, which is concentric with the housing. Typically, the rotor and shaft are constrained into fixed rotational relationship by a pair of eccentric meshing gears, one fixed to the rotary member and the other to the crankshaft. See. U.S. Pat. No. 4,156,586, FIG. 1, for example. Use of gears in this manner stems from the use of epitrochoidal or hypotrochoidal surfaces for the basic shape of the rotor, or the housing, the housing being the envelope of the rotor in the former case and the rotor being the envelope of the housing in the latter. Use of gears in this manner is so well known that it is apparently considered as part and parcel of these types of rotary devices, and need not even be claimed, their presence being felt to be implicit. See also U.S. Pat. No. 4,012,180, FIG. 7 and column 3, lines 26 et seq, as another example. The use of such gearing pairs is of course expensive, and desirably avoided if possible.

Another typical problem with prior art rotary pumping devices and the like, is that the chambers produced by the basic trochoidal shape with its envelope produces chambers which, although varying in volume with rotation of the rotor, do not reduce to zero. The volummetric compressive efficiencies of such devices leave something to be desired.

Another disadvantage that accrues from use of the basic trochoidal shapes is that the envelope is swept out by the apexes of the rotor and seals must be provided at these angular tips. In some instances the tips have been rounded to provide for substantial sized seals. However, this has lead to the necessity for the seals to travel radially to the rotor as its positions changes within the housing. Many solutions have been proposed for this seal problem, but, to the knowledge to the present inventor, none are entirely satisfactory. See U.S. Pat. Nos. 4,043,714, 4,012,180 and 4,018,548 for examples.

Another disadvantage of many prior art rotary displacement devices is the necessity to provide check valves and the like on inlet and outlet fluid passages through the housing, to prevent discharged fluids, compressible or incompressible as the case may be, from flowing back into the device after the discharge passage of the rotor.

Clearly, a need exists for a rotary displacement device, whether used for expansion or compression of compressible fluids, or pumping of incompressible fluids, that has improved volummetric efficiency, reduced or non-existent seal problems between the rotor and the housing, which needs no phasing gears nor check valves installed in the inlet and outlet passages. Further, there exists a need for a rotary pumping device wherein the inlet and/or outlet flow rates are constant rather than pulsating as with present devices.

BRIEF SUMMARY OF THE INVENTION

With the foregoing in mind, the present invention eliminates or substantially alleviates the shortcomings and disadvantages in the prior art. In its present preferred form, the invention comprises a triple tip rotor mounted for motion within a two-lobed housing shaped to correspond to the envelope defined by said tips when the rotor is impelled under the influence of an eccentric circular cam mounted upon a driving shaft centrally located with respect to the interior walls of the housing. A basic housing shape is defined based on appropriate equations, for a selected eccentricity value. The rotor shape is then defined based on conic equation principles. Subsequently, the basic rotor and housing shapes are both altered extending each point upon each of their peripheries perpendicular to the slope thereof a fixed distance equal to the selected eccentricity. The resulting triple tip rotor has substantially radiused tips. The rotor further comprises a geometrically centered circular perforation into which is installed the eccentrically mounted circular cam. The rotor position is determined at each instant by the cam rotary position and the three tips of the rotor, along with the two inwardly projecting tips of the housing. The rotor is impelled into rotary motion by rotation of the driving shaft. Its position is always defined by the tips and the position of the driving shaft, which places the eccentric cam in corresponding position with the rotor always contacting the housing along five contact lines as determined by the three tips of the rotor and the two inwardly projecting tips of the housing. That is, since the rotor is impelled by the cam directly, no gearing is necessary as in conventional rotary fluid movement devices. Further, it is possible to operate two assemblies of rotor, cam and housing upon the same shaft. When such assemblies are properly indexed rotationally, and the outlet and inlet chambers connected by external manifolding, the rate of change of the total working volume remains constant. As a consequence the flow rate through the device is constant. Of course, should pulsating flow be desired for some applications, a wide range of pulsating patterns may be achieved by indexing the two assemblies into proper rotational relationship.

It is therefore the object of the invention to provide a device operable as a rotary pump, compressor or expansion device, which has no indexing gears, and no inlet or outlet check valves. It is a further object that said device be operable in forward and reverse direction by corresponding rotation of the driving shaft. A further object is to provide such units coupled in pairs to produce a constant rate of fluid flow through the device upon rotation of the crank shaft at constant speed.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
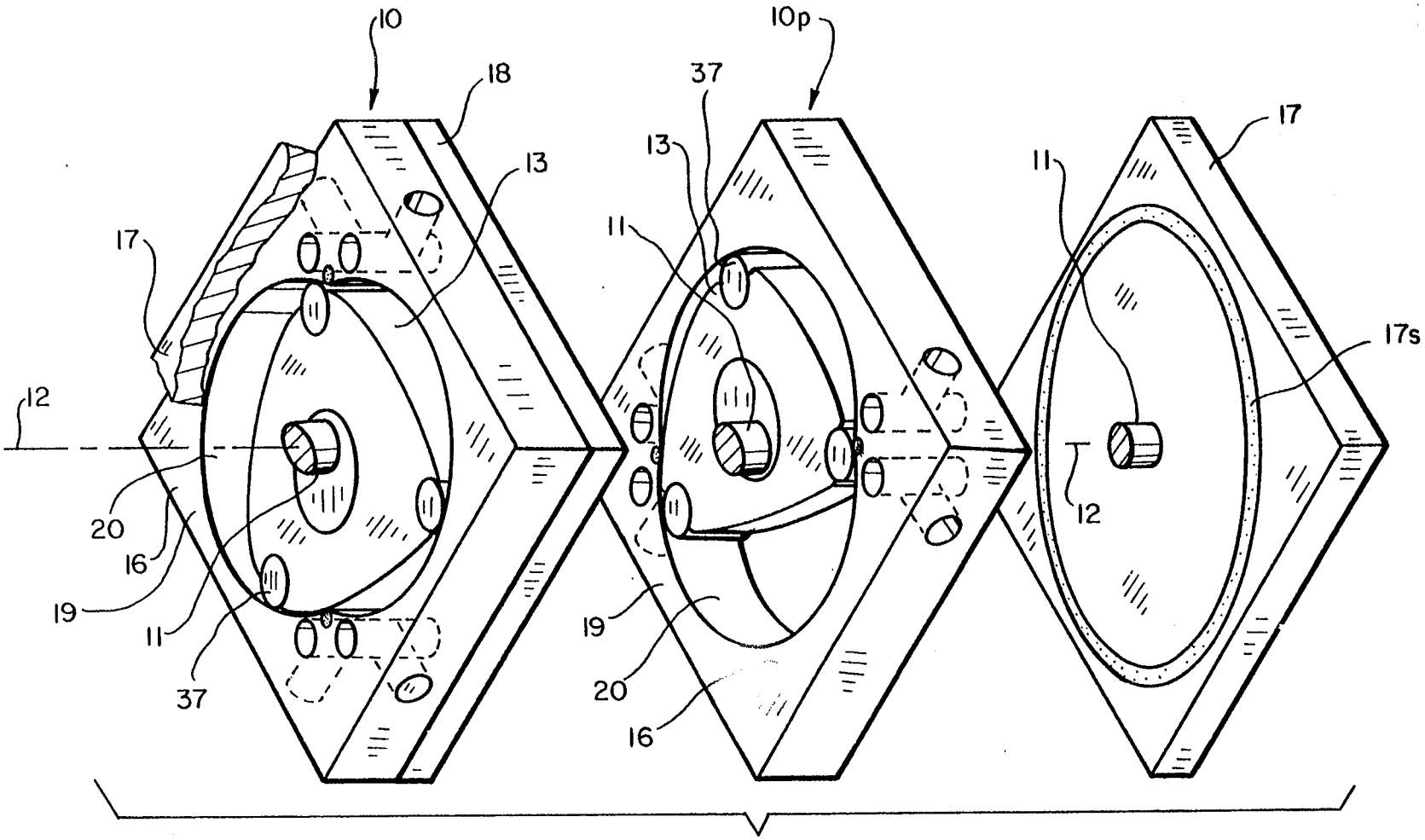
FIG. 1 is an exploded perspective view of a rotary fluid displacement device comprising a pair of such devices in accordance with the invention having a common shaft, drawn to substantially full scale, FIG. 2 a side elevation view of one of the pair of fluid displacement devices of FIG. 1, with the rotors shown in a position during operation thereof, drawn to the same scale, FIG. 3 the rotary displacement device of FIG. 2 shown with the rotor in a successive position, drawn to the same scale, FIG. 4 side elevation views of each of the pair of rotary fluid displacement devices of FIG. 1, showing relative rotational position of the housings thereof and the rotors and cams thereof, drawn to the scale of FIG. 1, FIG. 5 a diagramatic representation of the housing of a rotary fluid displacement device showing relationships between the rotor eccentricity the housing, and the rotor used in conjunction with the explanation of the determination of the geometries of the displacement devices, and FIG. 6 graphical representations of typical conic curves, showing the definition of parameters used in the calculation of the rotor outside contours.

Referring first to exploded FIG. 1 of the drawings, a device is seen comprising two rotary pump assemblies 10 and 10*p*, each in accordance with the invention, in paired relationship mounted upon a common shaft 11 having a longitudinal axis 12. As described subsequently, significant advantages accrue to the use of pump assembly 10 in such pairs. Each pump assembly 10 and 10*p* comprises a rotor 13 having three identically shaped curved edge portions 14 meeting in radiused apexes 15. Rotor 13 is installed within a housing 16 comprising end walls 17 and 18 along with a connecting sidewall 19. The latter wall has an internal surface 20 geometrically centered upon shaft axis 12 and provides an envelope for rotation of rotor 13 therein. Internal surface 20 comprises a pair of identically shaped lobes 21 and 22 connected by a pair of cusp-like portions 23 and 24. (FIGS. 2–5) Grooves 17*s* accept end wall seals, not shown.

Rotor 13 is geometrically centered about an axis 25 eccentric a distance 26 from longitudinal axis 12 of shaft 11. Circular cam 27 is secured non-rotatably eccentric to shaft 11, centered upon the geometric axis 25 of rotor 13.

Rotation of shaft 11 causes rotor 13 to turn about its center axis 28 while said center axis travels in a circular orbit about longitudinal axis 12 of shaft 11. As rotor 13 orbits about shaft 11, its rate of rotation about its own axis 28 is $\frac{1}{3}$ of that of cam 27 about shaft axis 12, so that three rotations of said shaft are required for one complete rotation of rotor 13. The instantaneous rotational orientation of rotor 13 is determined by the shape of the inside surface 20 of the sidewalls 19 upon which the radiused apexes 15 continuously ride. Rotor 13 also continuously bears against the radiused cusps 23 and 24 joining the lobes 21 and 22.

Near each side of each cusp 23 and 24 is a fluid passage 29 through sidewall 19 of housing 16, providing inlets and outlets for fluid being pumped through device 10 and 10*p*. As rotor 13 rotates and orbits about shaft axis 11, the three apexes 15, along with cusps 23 and 24 define internal chambers between the outside surface 14 of the rotor and the inside surface 20 of housing sidewall 19. The internal chambers 30 continuously change in volume, alternately increasing and decreasing to draw and expel fluid into and out of device 10.

Figure 3:
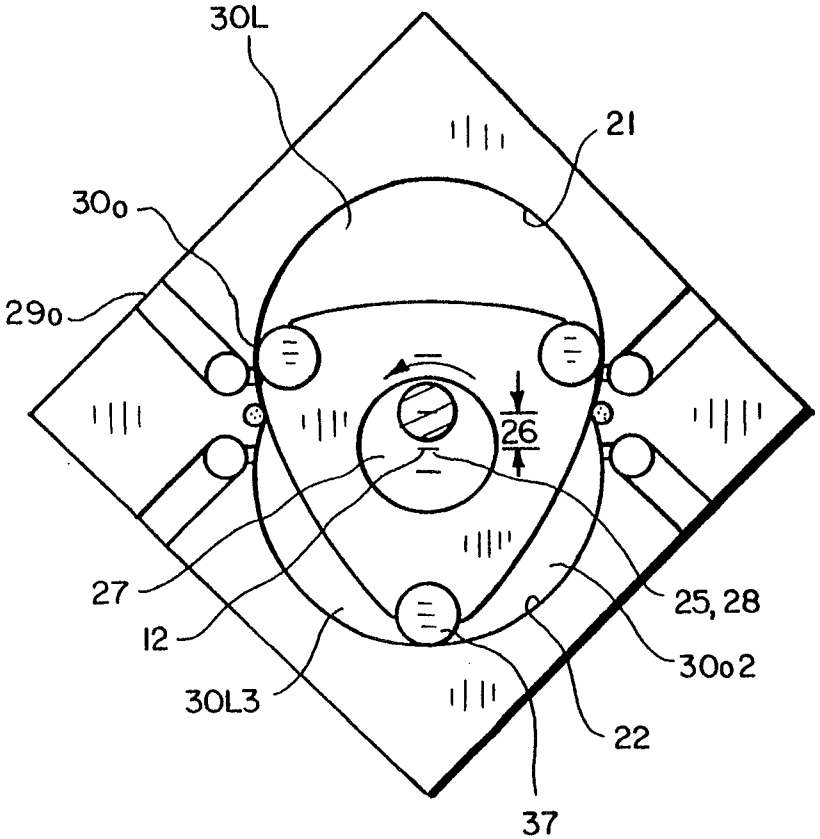
Figure 2:
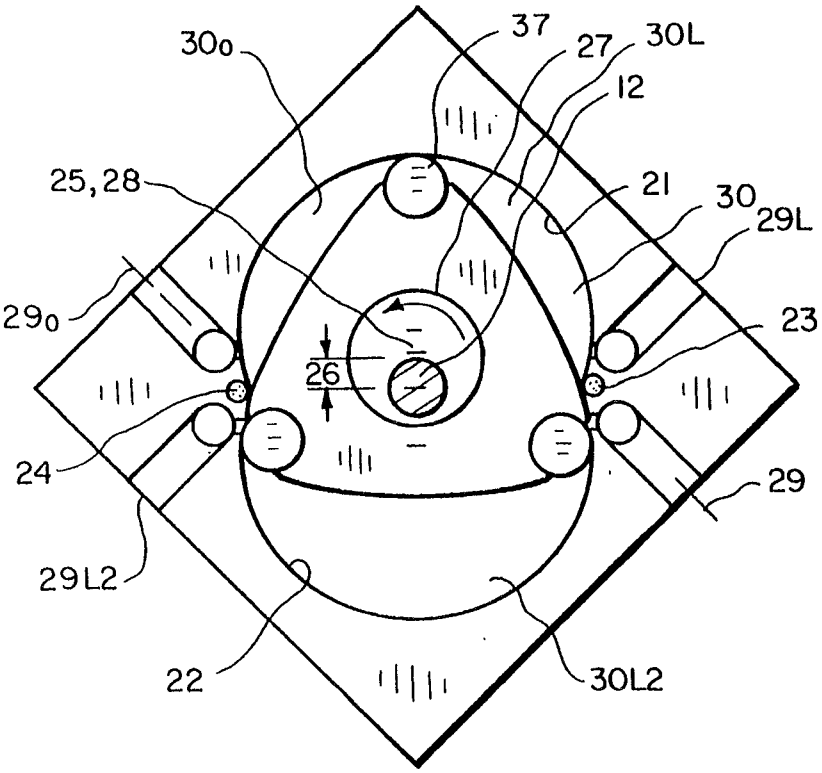

In FIGS. 2 and 3, rotor 13 is illustrated as rotating in the counterclockwise direction. In FIG. 2, counterclockwise rotating rotor 13 has defined an inlet chamber 30*i* which is increasing in volume drawing fluid through inlet 29*i*. At the same time, chamber 30*o* is decreasing in volume, expelling fluid through outlet 29*o*. At the particular illustrated moment, a third chamber 30*i*2 has increased to maximum volume and been filled by flow through inlet port 29*i*2.

In FIG. 3, rotor 13 has further turned about its center 25 60° in the counterclockwise direction, while shaft 11 has rotated a corresponding 180° in the counterclockwise direction. During this increment of rotation, inlet chamber 30*i* has grown to its maximum size while outlet chamber 30*o* has been reduced to zero, with all of the fluid therein expelled through outlet 29*o*. Inlet chamber 30*i*2 has become an outlet chamber 30*o*2 and has reduced in size by approximately $\frac{1}{2}$. A new inlet chamber 30*i*3 has been created and is increasing in size.

Figure 4:
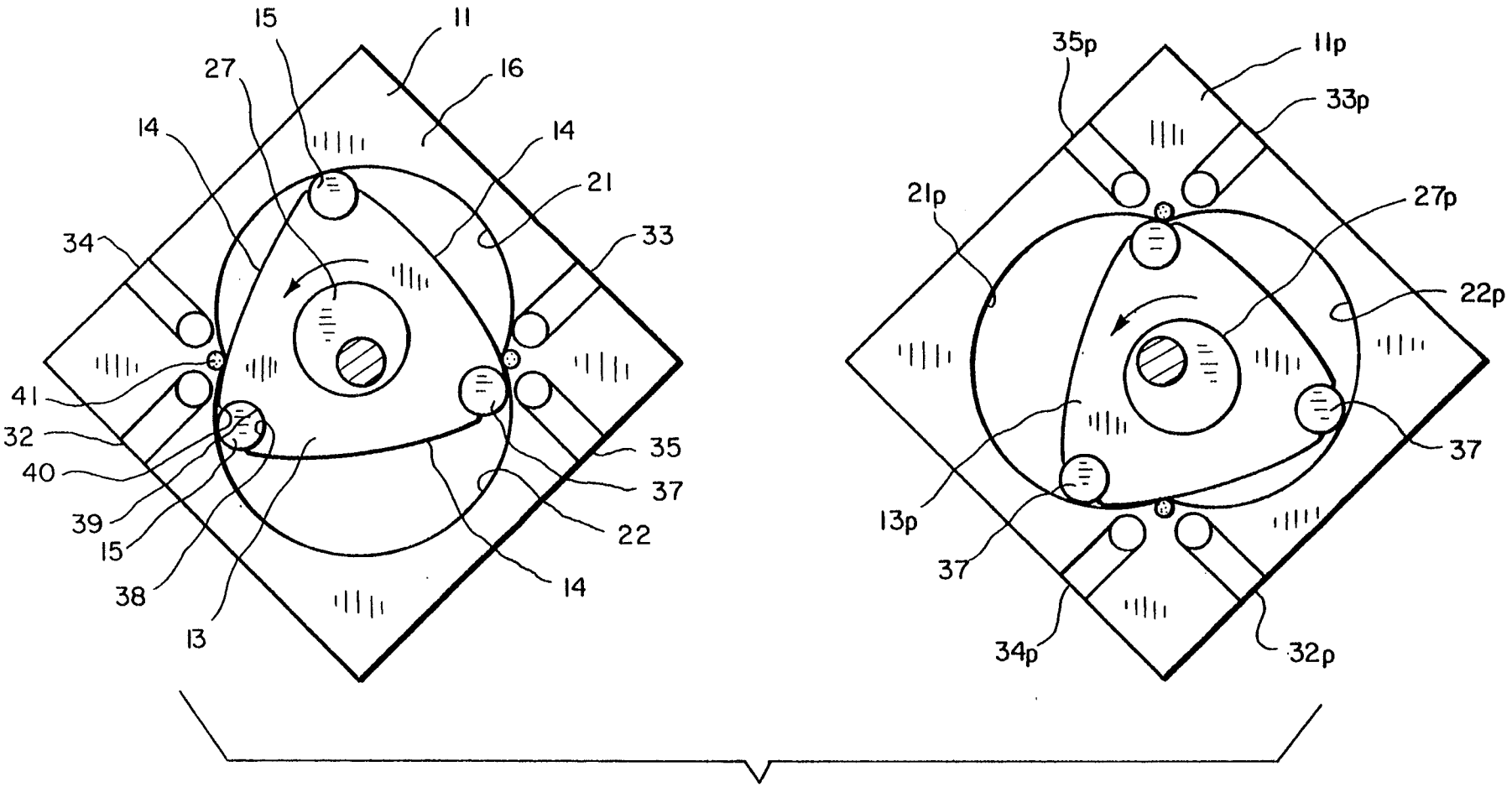

In FIG. 4, the geometric relationships of the paired devices 10 and 10*p* are shown schematically. The housings 11 and 11*p* are rotated so that pairs of lobes 21 and 22 are rotated 90° from each other. The circular cams 27 and 27*p* are affixed to shaft 11 rotated 180° from each other. This arrangement, with shark 11 and cams 27 and 27*p* statically and dynamically balanced, tends to eliminate vibration during operation. The rotors 13 and 13*p*, though each off center of shaft 11 by eccentric distance 26, are also rotationally positioned 180° apart, further assuring dynamic and static balance of the assembly.

If the outlet ports 34 and 35 of both devices 10 and 10*p* are all connected to a common header, not shown, the combined outflow rate of the paired devices is constant, given constant rate of rotation of shaft 11. The combined inflow rate is also constant and equal to the combined outflow rate. The existence of the constant combined flow rate has been verified by planimeter study as shown in Table I. For each equal increment of rotor rotation, the increment of combined total of inlet and outlet chamber area remains cons tank. The following table was obtained from layouts where the eccentricity 26 was 0.5 in.

TABLE 1

| Rotor 10 Position | Summed Intake Area 10 + 10p | Area Intake 10 + 10p | Summed Exhaust Areas 10 + 10p | Area Exhaust 10 + 10p |
|---|---|---|---|---|
| 0° | 9.80 in$^2$ | | 18.80 in$^2$ | |
| | | 1.50 in$^2$ | | 1.50 in$^2$ |
| 5 | 11.30 | | 17.30 | |
| | | 1.49 | | 1.49 |
| 10 | 12.79 | | 15.81 | |
| | | 1.50 | | 1.52 |
| 15 | 14.29 | | 14.29 | |
| | | 1.52 | | 1.50 |
| 20 | 15.81 | | 12.79 | |
| | | 1.49 | | 1.49 |
| 25 | 17.30 | | 11.30 | |
| | | 1.50 | | 1.52 |
| 30 | 18.80 | | 9.80 | |

The shape of sidewall 19 is such that both cusps 23 and 24 are in constant contact with rotor curved surfaces 14 or radiused apexes 15 in all of its rotated positions. All three radiused apexes 15 remain continually in contact with sidewall 19. Thus, there are five spaced apart points of contact as rotor 15 orbits and rotates (planetates about shaft 11) within housing sidewall 19, excepting only at momentary coincidence of a cusp and an apex. Four internal chambers are created between end walls 17 and 18, sidewall 19 and rotor edges 14. Each chamber expands to maximum volume as its leading apex approaches and reaches one of the cusps. Subsequently, said volume contracts to zero as its trailing approaches and reaches the same cusp. However, this zero volume condition substantially persists as the apex travels a substantial distance on both sides of the cusp. This not only assures high volumetric efficiency, but provides excellent locations for the fluid inlet ports 32 and 33 and the outlet ports 34 and 35.

The inside shape of housing 16 and outside shape of three-sided rotor 13 are derived together. First, an equilateral triangle (See FIG. 5) is constructed with one-third its height equal to $(2 \text{ Cos } 30+1)\epsilon$.* The apexes of this triangle coincide with the apexes of a basic preliminary rotor contour.

* $\epsilon$ corresponds to the eccentricity 26.

The basic inside shape of the housing sidewall 19 may then be calculated using the following equations to define a basic lobed, cusped, shape (See FIG. 5 ):

$$Xh=(\text{Cos } 3\alpha+\mathbf{K} \text{ Cos } \alpha)\epsilon$$

$$Y_h=(\text{Sin } 3\alpha+\mathbf{K} \text{ Sin } \alpha)\epsilon$$

where:

$X_h$ is the abcissa of a point on the basic sidewall contour.

$Y_h$ is the ordinate of said point, and $K=2\epsilon(2 \text{ Cos } 30°+1)$ $\epsilon$=eccentricity distance 26 of the circular cam 27.

$\alpha$=vector angle to point $X_h$, $Y_h$ from origin at geometric center of housing sidewall 19.

The final internal shape of housing 16 is defined by relocating each point ($X_h$ $Y_h$) the eccentric distance 26 ($\epsilon$) outwardly in a direction normal to the basic shape.

Figure 6:
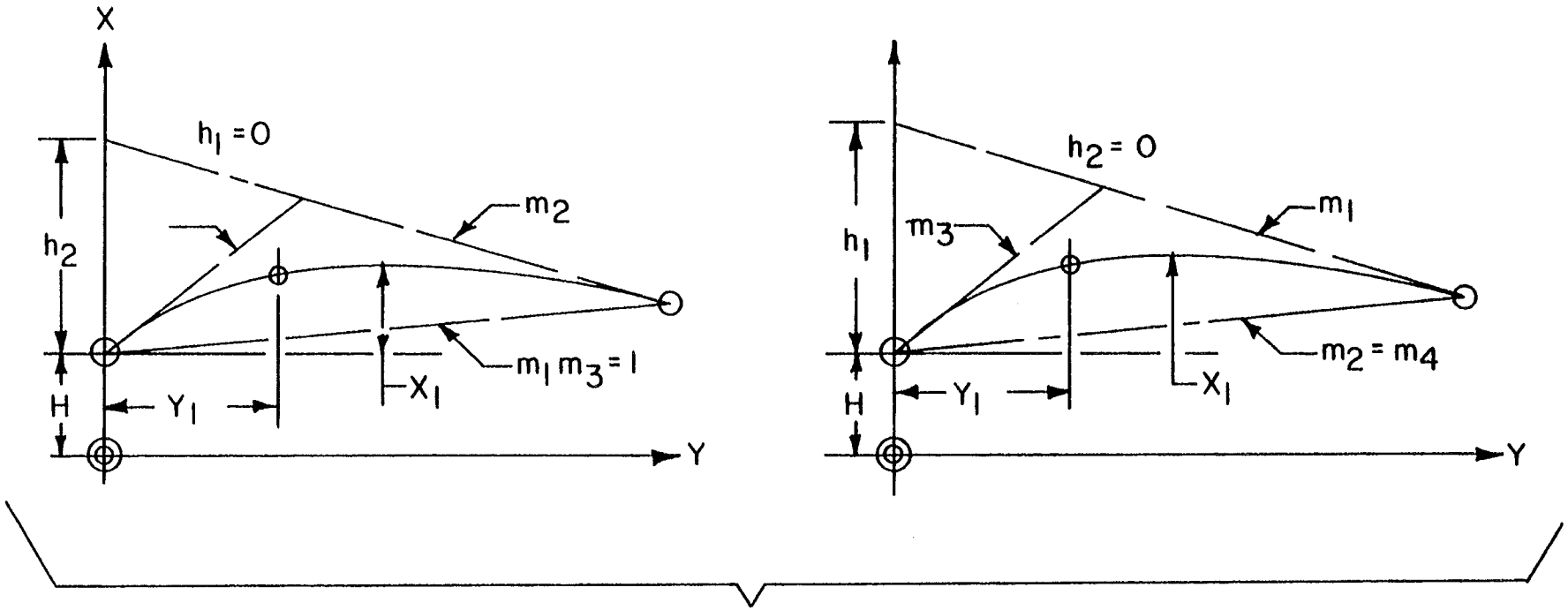

The shapes of the three identical curved edges of rotors 13 are also derived in two steps. First, a conic curve for one of the edges of the basic rotor contour is generated based upon the previously derived basic lobed, cusped, shape, using either a graphical or a mathematical method, both of which are well known. The use of either method requires knowledge of the slopes at known end points of the conic curve, along with the location of a third intermediate point. This method is often called the "point slope, point, point slope" method. With the slope and point knowledge, the conic curve can be developed point by point mathematically or graphically. The conic curve can be developed mathematically from this information using equations of the following forms. This procedure, and aforesaid graphical procedure, are commonly used for defining curves for aircraft fuselages for example. See FIG. 6 for definition of the indicated parameters and constants.

GENERAL FORM: $AX^2 + BXY + DY^2 + EX + FY = 0$ $A = K - m_3$ $B = 1 + m_1m_3 - K(m_2 + m_4)$ $E = h_1m_3 - h_2K$ $F = h_2m_4K - h_1$ $$X = cY + d + H \pm \sqrt{aY^2 + bY + d^2}$$

$$Y = cX + d \pm \sqrt{aX^2 + bX + d^2}$$

$$c = \frac{-B}{2A} \qquad a = c^2 - \frac{D}{A}$$

$$c = \frac{-B}{2D} \qquad a = c^2 - \frac{A}{D}$$

$$d = \frac{-E}{2A} \qquad b = 2cd - \frac{F}{A}$$

$$d = \frac{-F}{2D} \qquad b = 2cd - \frac{E}{D}$$

SLOPE AT KNOWN POINT $m_1, m_2, \quad m_4 = \frac{\Delta X}{\Delta Y}$

EVALUATING $\alpha, \beta, \gamma, \quad \delta$ AT THE POINT, $m_3 = \frac{\Delta Y}{\Delta X}$ WHERE $m_2 = m_4$ $$\frac{dx}{dy} = \frac{\frac{m_1}{\alpha} - \frac{2m_2}{\beta} - \frac{1}{\gamma}}{\frac{1}{\alpha} - \frac{2}{\beta} - \frac{m_3}{\gamma}}$$

$m_3 \quad m_4$ MUST PASS THRU "CONIC ORIGIN"

$m_2 = m_4$ or $m_1m_3 = 1$ $\alpha = X_1 - m_1Y_1 - h_1$ $\beta = X_1 - m_2Y_1 - h_2$ $\gamma = Y_1 - m_3X_1$ $\delta = X_1 - m_4Y_1$ WHERE $m_1m_3 = 1$ $$\frac{dx}{dy} = \frac{\frac{2m_1}{\alpha} - \frac{m_2}{\beta} - \frac{m_4}{\delta}}{\frac{2}{\alpha} - \frac{1}{\beta} - \frac{1}{\delta}}$$

$$K\beta\delta + \alpha\gamma = 0 \qquad K = \frac{-\alpha\gamma}{\beta\delta}$$

GENERAL CONIC GIVEN 2 POINT-SLOPERS, 1 POINT $m_2 = m_4$ $m_3 = 0$ $$\frac{-Y_1(X_1 - m_1Y_1 - h_1)}{(X_1 - m_2Y_1)^2}$$

$$c = m_2 - \frac{1}{2K}$$

$$c = \frac{2Km_2 - 1}{2(Km_2^2 - m_1)}$$

$$a = \frac{1 + 4K(m_1 - m_2)}{4K^2}$$

$$d = \frac{h_1}{2(Km_2^2 - m_1)} \qquad b = 2cd$$

$$b = \frac{h_1}{K}$$

$$a = c^2 - \frac{K}{Km_2^2 - m_1}$$

-continued

| | | | | | |
|---|---|---|---|---|---|
| $m_2 = m_4$<br>$m_1 = 0$<br>$m_3 = 0$ | $-\frac{Y_1(X_1 - h_1)}{(X_1 - m_2Y_1)^2}$ | $c = m_2 - \frac{1}{2K}$ | $d = 0$ | $c = \frac{2Km_2 - 1}{2Km_2^2}$ | $b = 2cd$ |
| | | $a = \frac{1 - 4Km_2}{4K^2}$ | $b = \frac{h_1}{K}$ | $d = \frac{h_1}{2Km_2^2}$ | $a = c^2 - \frac{1}{m_2^2}$ |

Figure 5:
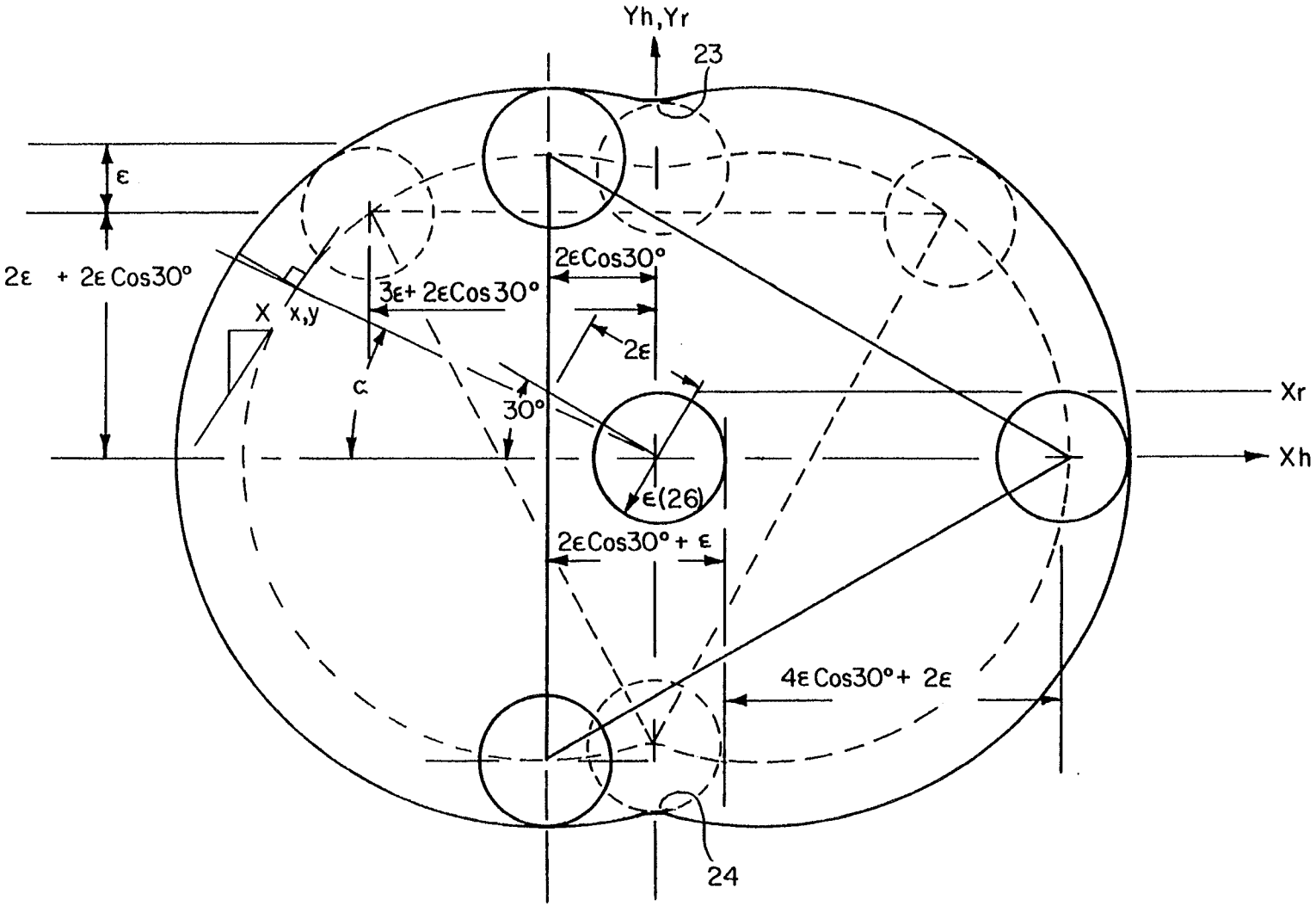

To determine the proints and slopes for the conic curve calculations, the previously discussed equilateral triangle is positioned rotated 90° from its original position, so that one of its sides is horizontal, as seen in dashed lines in FIG. 5. Then, e.g., its left apex is an end point for a ½ portion of one of the three rotor conic curves.

The slope and point data must be defined with respect to coordinates relating to the rotor ($X_r$, $Y_r$), rather than the coordinates ($X_h$, $Y_h$) of the housing contour. When the rotor is positioned as indicated by the dashed line triangle of FIG. 5, the abscissae of the rotor and housing coordinate systems coincide. However, the ordinate axis of the rotor system is displaced to a position parallel to the ordinate axis of the housing system but a distance therefrom equal to the eccentricity $\epsilon$ (26) The rotor system coordinates of the left apex point are $X_r=\epsilon(2 \text{ Cos } 30°+3)$, $Y_r=\epsilon(2 \text{ Cos } 30+1)$.

The slope at this apex point is determined graphically. The rotor position is layed out rotated 90°. In this position, as in all rotor positions, there must be no interference between the outside of the rotor and the inside of the housing. To avoid this interference, it was found graphically that the maximum permissible slope at the apex point was in fact 25.50° to the $X_r$ axes.

The other end point of this portion of the conic is the point at the tip of a cusp of the basic housing contour, and its associated slope is in fact zero. The coordinates of this second end point in the rotor system are $X_r=0$, $Y_r=\epsilon[2(2 \text{ Cos } 30°+1)-2]$.

The intermediate point is arbitrarily chosen and determined graphically. The rotor is again layed out in the rotor system rotated approximately 60°. It being required that the point being determined coincide with a point on the basic housing contour in the cusp area, such a point may be selected graphically from the layout along with its coordinates in the rotor system. Although it is known that the conic curve being developed will be tangent to the basic housing shape, it is not necessary to determine its slope.

Using these requisite point/slope, point, point/slope values, the conic curve of one-half of one of the three sides of the basic rotor contour is calculated mathematically or developed graphically. The coordinates of the points on this one-half curve are used to define all three complete rotor edge curves, symmetrically about rotor geometric center 28, which in device 10 is spaced the eccentric distance 26 (or $\epsilon$) from the shaft axis 12.

The second step, as with the sidewall contour determination, is to locate points on the final rotor edge curve the same eccentric distance ($\epsilon$) normally outward from the basic rotor edge curve. The resulting final rotor edge contour then comprises three circular arc tips with radii equal to the eccentric distance ($\epsilon$) 26, with the tips joined by tangent conic curves parallel to the basic edge curves, and a distance of the eccentricity outwardly therefrom.

While applicant does not yet understand the underlying reasons, he observed that the radiused rotor apexes 15 all remained constantly in contact with the housing sidewall surface 20 as rotor 13 was turned by shaft 11. At the same time, the rotor curved edges 14 remained constantly in contact with the tips of the rounded cusps 23. These relationships were first discovered through graphical layout studies, and later confirmed by prototype construction and tests.

Whatever its underlying mathematical cause, this observed phenomenon is highly fortunate, since the three apex to sidewall contact points and the two rotor edge to cusp contact points constantly position the rotor without any rotor-to-crankshaft gearing being required, as it is in prior art rotary devices.

To reduce rotor to housing frictions, rollers 37 are preferably provided at each apex 15 within a recess 38. The recess preferably has a semicircular bearing surface 39 joined by a pair of tangential planar portions 40. This permits roller 37 to drift outward under centrifugal force to firmly seal against sidewall surface 20. A cylindrical cusp seal 41 of rubberoid material is also advisable at each cusp 23 and 24 (FIG. 4). The projected outside surfaces of the rotor are tangent to the cylindrical surfaces of the rollers 37, which provide a portion of the selected rotor contour. The very small discontinuities created by the planar portions 40 do not noticeably effect performance. Similarly, the contour of each "cusp" is rounded at the tip, seal 41 closely approximating the actual calculated housing contour at these two locations.

Device 10 may be used as described to pump either liquid or gaseous fluids, It is entirely reversible, equally operable by rotation of shaft 11 in clockwise and counterclockwise directions.

Device 10 is also reversible in the sense it may also be used to deliver power through rotation of shaft 11. This is done by providing pressurized fluid, liquid or gaseous, into device 10 through the input ports 29, This causes rotor 15 to rotate shaft 11 under the impetus of unbalanced pressure forces applied to rotor edges 14, providing output shaft rotary power.

What is claimed and desired to be protected by United States Letters Patent is:

1. A rotary device such as a fluid pump, compressor, expansion engine or the like, comprising:

a chamber geometrically centered about an axis, said chamber being formed by a pair of parallel spaced apart end walls, each with an inwardly facing planar surface, and a sidewall with an inwardly facing contoured surface centered about said axis;

a shaft disposed through the end walls to rotate about the axis of the chamber;

a radially projecting circular cylindrical cam affixed to the shaft to rotate therewith , the center of said cam being an eccentric distance from the axis of the shaft;

a rotor mounted for relative motion within the chamber, having a central perforation disposed about the cam in sliding contact therewith, the edge surface of said rotor having three joined identical curved portions each defined by points offset normally outward said cam eccentric distance from a conic section curve, so that said edge surface includes three apexes with radii equal to said eccentric distance; wherein the inwardly facing surface of the sidewall of the chamber comprises a pair of identically shaped lobe portions joined by a pair of cusp-like portions, the size and shape of said inwardly facing surface being such that the rotor revolves with said radiused apexes all continuously in contact therewith and with said rotor edge surface continuously in contact with both of said cusp-like portions, the cam and the shapes of the rotor and the inwardly facing surface of the sidewall being the sole means for guiding the rotor within the chamber, a plurality of fluid working chambers being formed between the rotor and the sidewall; and a pair of fluid flow passages through the sidewall comprising one passage at each side of each cusp-like portion, so that one passage may serve as a fluid outlet and the other as a fluid inlet.

2. A rotary device comprising at least one pair of rotary devices in accordance with claim 1, wherein:

the individual devices have a common shaft and the chambers thereof are affixed together with the lobes thereof rotated 90° with respect to each other, and the cams thereof are fixed upon the common shaft rotated 180° with respect to each other; so that when the device is used as a pump and the fluid outlet passages of the pair of devices are all joined to a common outlet flow header and the fluid inlet passages to a common source of fluid, the rate of flow through said header will be constant when the rate of rotation of the shaft is constant.

3. The rotary device of claim 1, wherein:

the rotor comprises a roller with radius equal to said cam eccentric distance installed within a recess provided at each apex thereof, said roller being positioned so that the cylindrical surface is continuously located so that a portion thereof provides the radiused portion of said apex and so that the continuity of the contour of the rotor is substantially preserved.

4. The rotary device of claim 1, wherein the inwardly facing contoured surface of the sidewall is determined by first defining a preliminary basic shape in accordance with the following steps:

constructing an equilateral triangle having one-third of its height equal to $(2 \text{ Cos } 30+1)\epsilon$;

calculating the inside shape Of the housing sidewall using the following equations to define a basic lobed, cusped shape $X_h=(\text{Cos } 3\alpha+K \text{ Cos } \alpha)\epsilon$ and $Y_h=(\text{Sin } 3\alpha+K \text{ Sin } \alpha)\epsilon$ wherein:

$X_h$ is the abcissa of a point on the basic sidewall contour, $Y_h$ is the ordinate of said point, and $K=2\epsilon(2 \text{ Cos } 30°+1)$ $\epsilon$=eccentricity distance between the axis of the shaft and the axis of the radially projecting circular cylindrical cam to be affixed to the shaft to rotate therewith;

$\alpha$=vector angle to point $X_h$, $Y_h$, from an origin selected to be at the geometric center of the housing sidewall; and then relocating each point ($X_h$, $Y_h$) the distance equal to said eccentricity distance outwardly in a direction normal to the basic shape so determined; and determining the shapes of three identical curved portions of the rotor by the steps, generating a conic curve for one of the edges of a basic rotor contour based upon the previously derived basic lobed, cusped, shape using the graphical method commonly known as the "point/slope, point, point/slope" method, wherein the slopes and point are determined by, rotating said equilateral triangle 90 so that one of its sides is horizontal, so that its left apex is an end point for a one-half portion of one of the three rotor conic curves, determining the slope at the left apex point graphically as the maximum slope at said point permissible without resulting in interference between the outside surface of the rotor and the inside surface of the basic housing;

observing that the other end point of this portion of the conic is a point at the tip of a cusp of the basic housing contour and is equal to zero, picking an arbitrary intermediate point and graphically determining the slope at this point;

graphically generating a conic curve of ½ of the three sides of the basic rotor contour using the point/slope, point, point/slope values so derived;

locating points on the rotor edge curve as being the eccentric distance $\epsilon$ normally outward from the basic rotor edge curve.

* * * * *